US007696892B2

(12) United States Patent
Huet et al.

(10) Patent No.: US 7,696,892 B2
(45) Date of Patent: Apr. 13, 2010

(54) PROTECTION DEVICE FOR AN OSCILLATING POWER CIRCUIT

(75) Inventors: Guillaume Huet, Bourges (FR); François Orquera, Trouy (FR)

(73) Assignee: Nexter Systems, Roanne (FR)

( * ) Notice: Subject to any disclaimer, the term of this patent is extended or adjusted under 35 U.S.C. 154(b) by 453 days.

(21) Appl. No.: 11/723,885

(22) Filed: Mar. 22, 2007

(65) Prior Publication Data

US 2007/0230071 A1 Oct. 4, 2007

(30) Foreign Application Priority Data

Apr. 3, 2006 (FR) ..... 06 02964

(51) Int. Cl.
*G08B 21/00* (2006.01)

(52) U.S. Cl. ..... 340/664; 340/635; 340/636.12; 340/636.17; 340/638; 340/654; 340/687; 361/45; 361/49; 361/95; 361/96; 324/258

(58) Field of Classification Search ..... 340/664, 340/635, 636.12, 636.17, 638, 654, 687; 361/45, 49, 95, 96; 324/258
See application file for complete search history.

(56) References Cited

U.S. PATENT DOCUMENTS 5,060,166 A 10/1991 Engel et al.
5,546,266 A * 8/1996 Mackenzie et al. ..... 361/93.4
6,002,321 A 12/1999 Laine
6,587,051 B2 * 7/2003 Takehara et al. ..... 340/635

FOREIGN PATENT DOCUMENTS

FR 2 750 204 12/1997

* cited by examiner

*Primary Examiner*—Tai T Nguyen
(74) *Attorney, Agent, or Firm*—Oliff & Berridge, PLC

(57) ABSTRACT

A protection device for an oscillating power circuit, namely for a demining coil, such device incorporating circuit breaking means positioned between an alternating current supply network and the power circuit, such device wherein it comprises at least one means to measure and analyze the current supplying the power circuit, means able to detect the appearance of a direct current and connected to triggering means ensuring the opening of the circuit breaking means when the alternating current ceases.

6 Claims, 2 Drawing Sheets

PROTECTION DEVICE FOR AN OSCILLATING POWER CIRCUIT

BACKGROUND OF THE INVENTION

1. Field of the Invention

The technical scope of the invention is that of protection device for oscillating power circuits.

2. Description of the Related Art

It is classical to protect a power circuit from excess voltage by providing a circuit breaking organ able to detect the excess voltage, for example a circuit-breaker or else a fuse.

However, certain types of circuit and namely oscillating circuits risk being deteriorated by the presence of a direct current.

For example, the coils used in electromagnetic mine clearance devices (such as those described namely by patent FR2750204) are sensitive to direct currents which may deteriorate them after a certain period of time, even if these currents are of a voltage level which falls under a given threshold.

SUMMARY OF THE INVENTION

The aim of the invention is to propose a protection device ensuring protection against the appearance of such direct currents.

Thus, the invention relates to a protection device for an oscillating power circuit, namely for a demining coil, such device incorporating circuit breaking means positioned between an alternating current supply network and the power circuit, such device wherein it comprises at least one means to measure and analyze the current supplying the power circuit, means able to detect the appearance of a direct current and connected to triggering means ensuring the opening of the circuit breaking means when the alternating current ceases.

The means to measure and analyze the current may comprise a logic module incorporating a retriggerable monostable component whose tripping is controlled periodically by the variation in the current from the supply network, such component wherein the suspension of tripping activates the appearance of an error signal used by the triggering means to cause the opening of the circuit breaking means.

The measurement and analysis means may also incorporate a measurement module ensuring an estimation of the value of the current from the supply network, the measurement module incorporating comparator means ensuring the comparison of the measured value with a predetermined threshold, the result of this comparison being used by the triggering means to cause the opening of the circuit breaking means.

Advantageously, the triggering means will also be connected to display means enabling the state of the circuit breaking means to be indicated.

The invention also applies to the application of such a device to the protection of a demining coil.

BRIEF DESCRIPTION OF THE DRAWINGS

The invention will become more apparent from the following description of a particular embodiment, such description being made with reference to the appended drawings, in which.

DETAILED DESCRIPTION OF PREFERRED EMBODIMENTS

Figure 1:
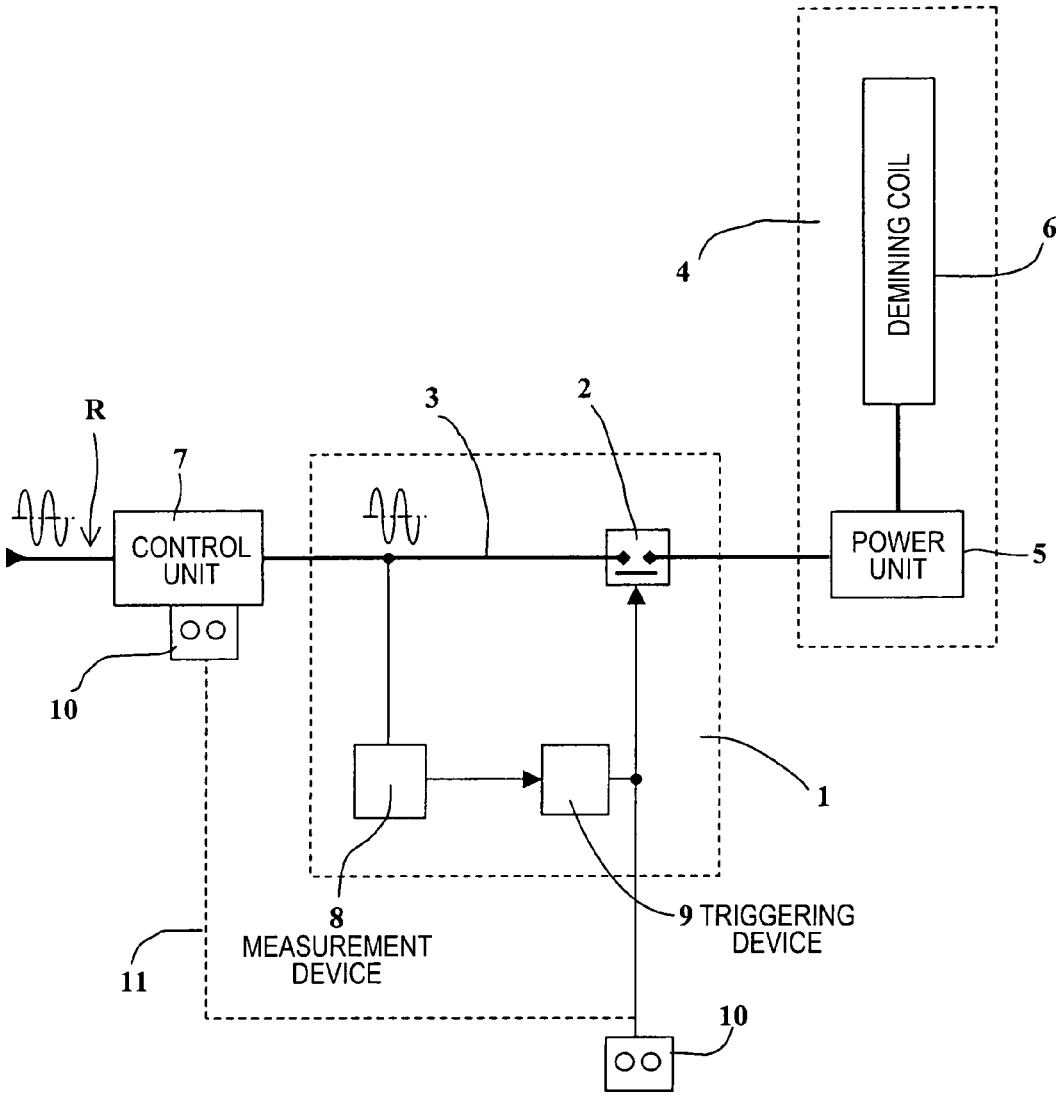
FIG. 1 is a block diagram showing a device according to the invention.

With reference to FIG. 1, a protection device 1 according to the invention incorporates circuit breaking means 2 positioned on a power conductor 3 connected to a direct current supply network R, for example a vehicle network.

The circuit breaking means 2 are positioned upstream of a power circuit 4 which here incorporates a power unit 5 linked to a demining coil 6.

A control unit 7 is positioned upstream of the circuit breaking means 2. It enables the shape of the signals generated by the coil 6 to be piloted and it incorporates a man-machine interface enabling the demining device itself to be piloted.

The device 1 also comprises means 8 to measure and analyze the current intended to supply the power circuit 4.

These measurement means 8 are linked to triggering means 9 which enable the opening of the circuit breaking means 2 to be controlled.

In accordance with the invention, the measurement means 8 are designed so as to be able to detect the appearance of a direct current in the power conductor 3.

Display means 10 are also linked to the triggering means 9 and enable the open or closed state of the circuit breaking means 2 to be displayed.

These display means 10 may, for example, comprise two differently colored lights, one color corresponding to the open position of the circuit breaking means 2 and the other the closed position.

It is naturally possible, to ease the implementation of the device, for the display means 10 to be offset onto the control unit 7 or its man-machine interface. FIG. 1 shows a link 11, in dotted lines, which illustrates such a link with offset display means 10.

Figure 2:
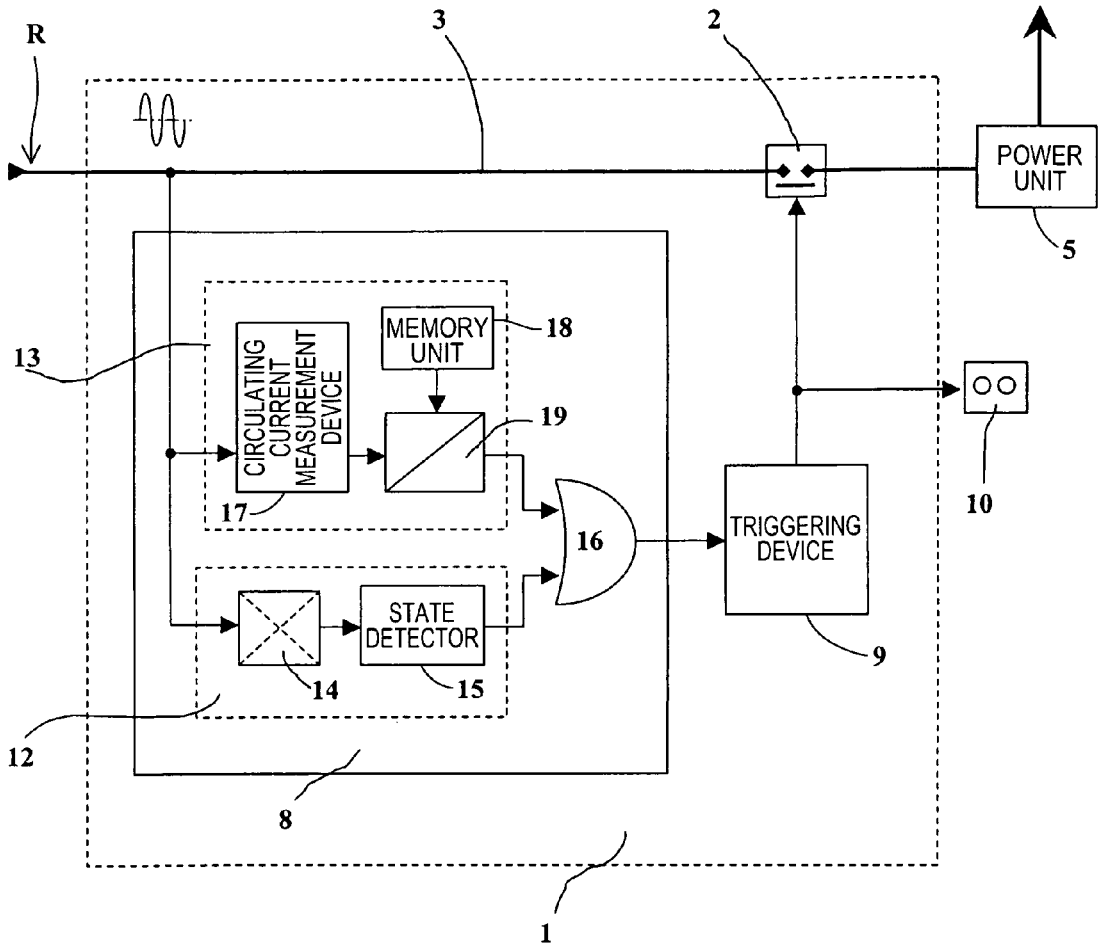
FIG. 2 is an organizational flowchart showing in greater detail an embodiment of the device according to the invention.

FIG. 2 shows the organic and functional structure of the device 1 in greater detail.

The means 8 to measure and analyze the current comprise two different modules: a logic module 12 and a measurement module 13.

The logic module 12 incorporates a retriggerable monostable component 14 (for example a component known under the standardized name of 74HC4538). The logic output of this component alternates with a frequency which is that of the current circulating in the power conductor 3.

This monostable component 14 is linked to a state detector 15 (for example a latch D) which enables a suspension of the tripping of the monostable 14 to be detected. The suspension of such tripping corresponds to the suspension of the oscillation of the current which means that there is no longer any current circulating in the power conductor 3, or that such current is direct. The state detector 15 in this case supplies a signal error (passage into a logic state 1, for example), such signal being applied to the triggering means 9 by an OR logic gate 16.

The triggering means 9 thus cause the circuit breaking means 2 to open.

The state detector may be made in the form of a specialized electronic component (for example, a component known under the standardized name of 74HC74). It may simply be constituted by a software module incorporated into a computer, such module being programmed so as to detect the suspension of the oscillations at the monostable's 14 output.

Such a computer may furthermore be programmed so as to monitor the shapes of more complex currents.

The triggering means 9 may, for example, by constituted by a control circuit to open the circuit breaking means 2. If the circuit breaking means 2 are constituted by a static switch such as a thyristor, the triggering means 9 may, for example, be the electronic circuit controlling the trigger of said thyristor.

The measurement module 13 incorporates means 17 to ensure the measurement of the value of the current circulating in the supply network and the conductor 3. The current measurement components are well known to the Expert and may be of analogical or digital technology.

The measurement module 13 also incorporates a memory or register 18 which incorporates a threshold value. Lastly, the measurement module incorporates a comparator 19 which ensures the comparison of the value measured by means 17 and the threshold contained in the memory 18.

The comparator is designed so as to deliver a signal (for example, a logic state 1), such signal being applied to the triggering means 9 by the logic gate 16.

Without departing from the scope of the invention, the memory 18 may be designed in the form of calibrated electronic components incorporated in an analogical comparator 19 made, for example, in the form of a bridge.

More simply, a computer may be implemented that ensures the digital comparison of the measured current with a value memorized in the computer. This solution offers the advantage of enabling the easy modification of the threshold by reprogramming.

As may be seen, using the invention enables the circuit breaking means 2 to be activated both during the appearance of an excessive intensity level and when the current passes from an alternating state to a direct state.

This results in improved protection for those components likely to be deteriorated by a direct current.

Note that the device according to the invention also ensures the breaking of the power circuits when the current is suspended. Insulation and protection of the circuit is thereby improved outside of the phase of use.

It is also possible for a logic module 12 to be implemented able to detect a direct component over an oscillating signal. For this, a stage comprising a filter to eliminate the alternating component followed by an evaluator measuring the direct component merely needs to be added to the logic module 12 in parallel with means 14 and 15. This evaluator will incorporate a comparator linked to another memory in which a threshold level for the direct current will be programmed.

The circuit breaking means 2 may thus be activated when the current circulating in the control means incorporates a direct component exceeding a predetermined level.

The invention has been described with reference to diagrams which do not prejudice any technical means implemented in practice.

It is naturally possible for the means constituting the device 1 to be advantageously made in whole or in part using a micro-processor or computer which will incorporate software means firstly to ensure the comparison of the current's intensity level with a pre-programmed threshold and secondly to enable the suspension of the current's oscillations to be detected.

The invention has been described in its application to the protection of a demining coil. It may naturally also be applied to the protection of other types of electronic circuits likely to be deteriorated by direct current.

What is claimed is:

1. A protection device for an oscillating power circuit, namely for a demining coil, such device incorporating a circuit breaking means positioned between an alternating current supply network and the power circuit, wherein the protection device comprises at least one means to measure and analyze a current supplying to the power circuit, means able to detect an appearance of a direct current and connected to a triggering means ensuring an opening of the circuit breaking means when an alternating current ceases.

2. A protection device according to claim 1, wherein the means to measure and analyze the current comprise a logic module incorporating a retriggerable monostable component module incorporating a retriggerable monostable component whose tripping is controlled periodically by a variation in the current from the supply network, the component which suspension of tripping controls the appearance of an error signal used by the triggering means to cause the opening of the circuit breaking means.

3. A protection device according to claim 2, wherein the measurement and analysis means incorporate a measurement module ensuring an estimation of a value of the current from the supply network, the measurement module incorporating a comparator means ensuring a comparison of the value of the current with a predetermined threshold, a result of this comparison being used by the triggering means to cause the opening of the circuit breaking means.

4. A protection device according to claim 1, wherein the triggering means are also connected to a display means enabling a state of the circuit breaking means to be displayed.

5. A protection device according to claim 3, wherein the triggering means are also connected to a display means enabling a state of the circuit breaking means to be displayed.

6. Application of the protection device according to claim 1 to protection of a demining coil.

* * * * *